United States Patent [19]

Masaki et al.

[11] 4,291,658

[45] Sep. 29, 1981

[54] AUTOMOTIVE ENGINE CARBURETOR

[75] Inventors: Kenji Masaki, Yokohama; Koyo Nakamura, Yokosuka, both of Japan

[73] Assignee: Nissan Motor Company, Limited, Yokohama, Japan

[21] Appl. No.: 954,766

[22] Filed: Oct. 26, 1978

Related U.S. Application Data

[60] Division of Ser. No. 854,230, Nov. 23, 1977, abandoned, which is a continuation of Ser. No. 654,742, Feb. 23, 1976, abandoned.

[30] Foreign Application Priority Data

Feb. 5, 1975 [JP] Japan ..... 50-15129

[51] Int. Cl.[3] ..... F02M 7/00; F02M 23/00

[52] U.S. Cl. ..... 123/440; 60/285; 60/299; 123/589

[58] Field of Search ..... 123/440, 438, 585, 589; 60/285, 299

[56] References Cited

U.S. PATENT DOCUMENTS

| | | | |
|---|---|---|---|
| 3,861,366 | 1/1975 | Masaki et al. | 123/106 |
| 3,906,910 | 9/1975 | Szlaga, Jr. | 123/119 EC |
| 3,921,612 | 11/1975 | Aono | 123/119 R |
| 3,942,493 | 3/1976 | Linder et al. | 123/119 D |

FOREIGN PATENT DOCUMENTS

| | | |
|---|---|---|
| 630807 | 3/1927 | France . |
| 2182387 | 4/1972 | France . |

*Primary Examiner*—Wendell E. Burns

[57] ABSTRACT

A compensating member is provided in a conventional automotive engine carburetor, which is used with an electronic closed loop control system, in order to finely adjust a rate of air flow being delivered to a fuel passage extending between a discharge nozzle and a float bowl, and thereby performing a fine adjustment of an air-fuel mixture ratio to effectively reduce noxious components in exhaust gases.

4 Claims, 7 Drawing Figures

AUTOMOTIVE ENGINE CARBURETOR

This is a division, of application Ser. No. 854,230, filed Nov. 23, 1977 which in turn was a continuation of application Ser. No. 654,742 filed Feb. 23, 1976, both now abandoned.

The present invention relates generally to an automotive engine carburetor, and more particularly to an improvement in such a carburetor which controls the air-fuel mixture ratio in response to an electrical signal applied thereto.

Various systems have been proposed to optimally control the air-fuel ratio of an air-fuel mixture to an internal combustion engine in dependence of modes of engine operation in order to effectively reduce noxious components (such as nitrogen oxides ($NO_x$), carbon monoxide (CO), and hydrocarbons (HC)) contained in exhaust gases, one of which systems is to utilize the concept of electronic closed loop system based on a sensed concentration of a component in exhaust gases of the engine. Each of these closed loop systems, especially when a so-called three-way catalytic converter is employed for the reduction of the noxious components, is required to finely control the air-fuel mixture ratio to a considerable extent. This is because the effect of the three-way catalytic converter is maximized when the air-fuel ratio is maintained in the vicinity of stoichiometric air-fuel ratio. Therefore, a carburetor for use with the electronic closed loop control system is usually equipped with an electrical unit for the purpose of fine control of the air-fuel ratio of the air-fuel mixture. A three-way catalytic converter, as is well known, has a characteristic of deoxidizing $NO_x$ and oxidizing both CO and HC at the same time.

However, none of the conventional mass produced carburetors has a compensating or auxiliary element which serves to readily and finely adjust the air-fuel ratio to adequate set points in a manufacturing process. Furthermore, ready adjustments to compensate for changes of the set points with the passage of time are not possible. As a result, the conventional carburetors each, because of the absence of the compensating element, has not been suitable for mass-production and lacked in reliability of proper operations in effective reduction of the noxious components due to the undesirable change of the set points with the passage of time.

It is therefore an object of the present invention to provide a conventional automotive carburetor with a compensating or auxiliary element for fine adjustment of an air-fuel mixture ratio.

This and other objects, features and many of the attendant advantages of this invention will be appreciated more readily as the invention becomes better understood by the following detailed description, wherein like parts in each of the several figures are identified by the same reference characters, and wherein.

Figure 6A:
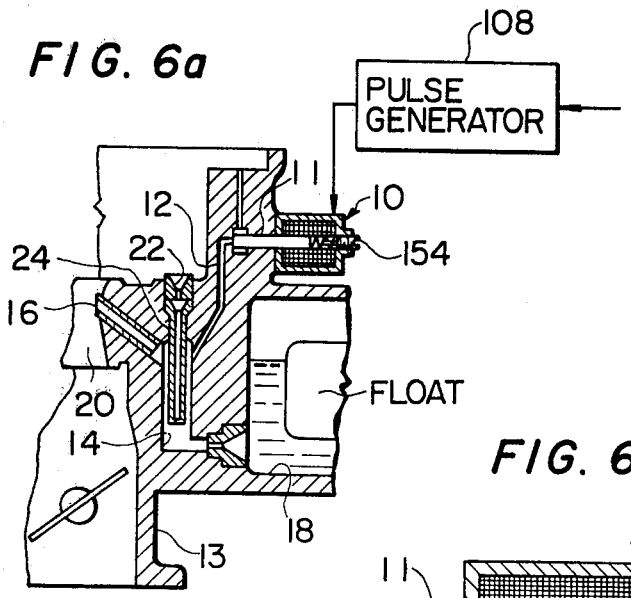

FIG. 6*a* shows a third preferred embodiment of the present invention; and

Figure 6B:
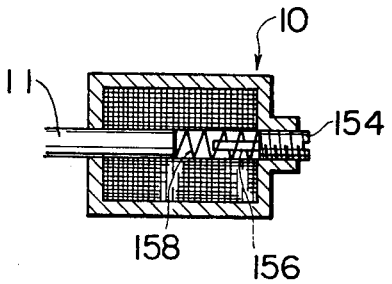

FIG. 6*b* is an enlarged fragmentary view of a part of FIG. 6*a*.

Figure 1:
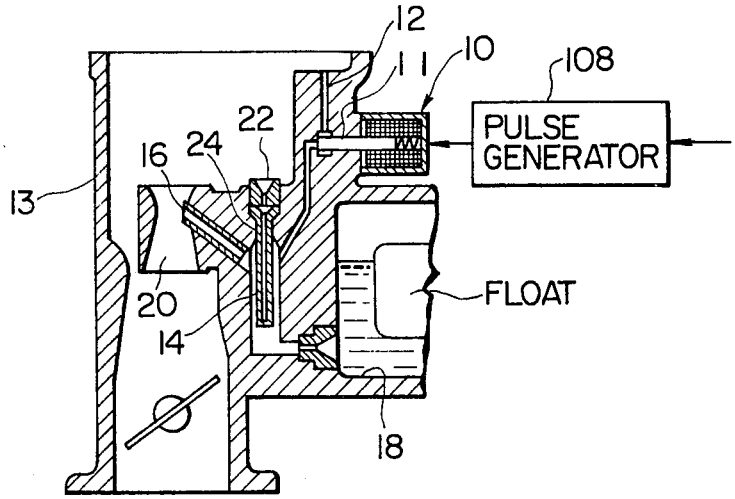
FIG. 1 illustrates an example of a conventional automotive carburetor.

Reference is now made to drawings, first to FIG. 1, wherein there is schematically illustrated, in a cross sectional view, a conventional carburetor for use with an electronic closed loop air-fuel ratio control system. An electromagnetic valve assembly 10 is provided to control the rate of air delivered to a fuel passage 14 through an air passage 12 in a manner to reciprocally move a plunger 11 thereof in response to an electrical pulsating signal applied thereto. In other words, the electromagnetic valve assembly 10 controls the air-fuel ratio of an air-fuel mixture sucked into an intake passage 13 by moving the plunger 11 to a position which allows the air flow to pass therethrough or vice versa. The electrical signal is generated by a pulse generator 108 which forms part of the control system to be described later in detail in conjunction with FIGS. 2 and 3. The air passage 12 is opened at its one end to communicate with the intake passage 13 and connected at the other end to the fuel passage 14. The fuel passage 14 is terminated at a discharging nozzle 16 and extends between a float bowl 18 and a venturi 20. An air bleed hole 22 is located in the upper section of an air bleed assembly 24 for introduction of air to the fuel passage therethrough.

In the above-mentioned conventional carburetor, when the aforementioned three-way catalytic converter is employed in order to effectively reduce noxious components in exhaust gases, the air-fuel ratio of an air-fuel mixture should be finely adjusted. This is because, as is described at the outset of this specification, the effect of the three-way catalytic converter is maximized in reduction of the noxious components when the air-fuel ratio is maintained in the vicinity of stoichiometry. Therefore, as the air-fuel ratio is mainly determined by the ratio of open to close duration of the electromagnetic valve assembly 10, the ratio should be finely adjusted in order to maintain a richer and a leaner air-fuel mixture a little below and a little above stoichiometry, respectively. In the above, in order to secure stable engine operation, the leaner air-fuel mixture is, in general, set at an air excessive ratio (viz., actual air-fuel ratio:stoichiometric air-fuel ratio) about 1.05–1.10.

However, it is very difficult or impossible that all of the carburetors are finely adjusted, with respect to desired set points of air-fuel ratio, to a considerably extent during mass-production process, and furthermore, even if finely adjusted, there is a possibility that the desirable set points are liable to change with the passage of time. In the conventional carburetor for use with an electronic close loop air-fuel control system, the above-described attention has not been paid hitherto.

The present invention includes, therefore, an improved means which is provided in the air passage 12 to readily and finely adjust the amount of air flowing therethrough, and thereby performing the aforementioned purpose of the effective reduction of the noxious components especially when a three-way catalytic converter is employed.

In the following, prior to describing the embodiments of the present invention, exemplified is a conventional electronic closed loop control system for use with both the FIG. 1 conventional carburetor and also the embodiments of the present invention.

Figure 2:
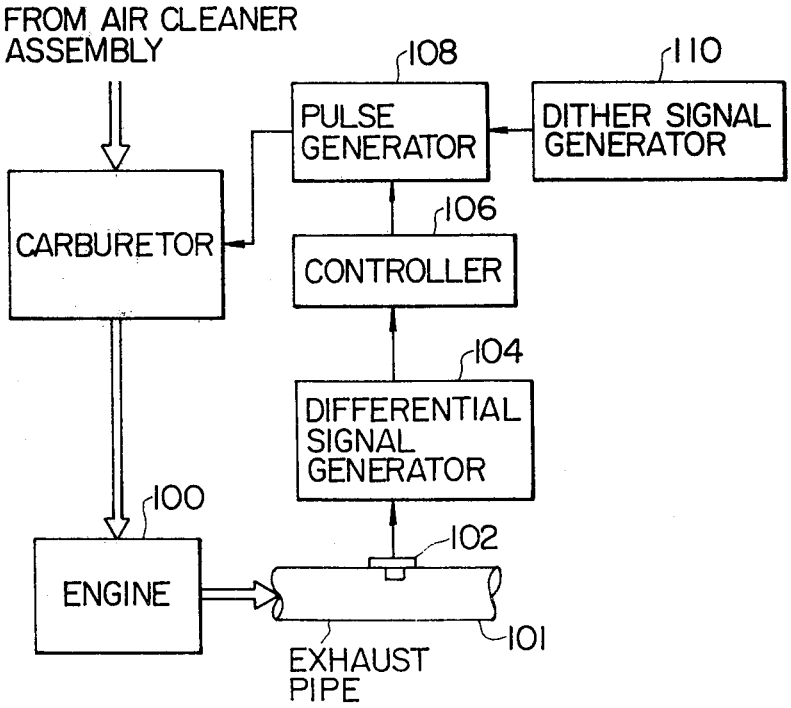
FIG. 2 illustrates an example of a conventional electronic closed loop control system for use with the FIG. 1 carburetor and several preferred embodiments of the present invention.
Figure 3:
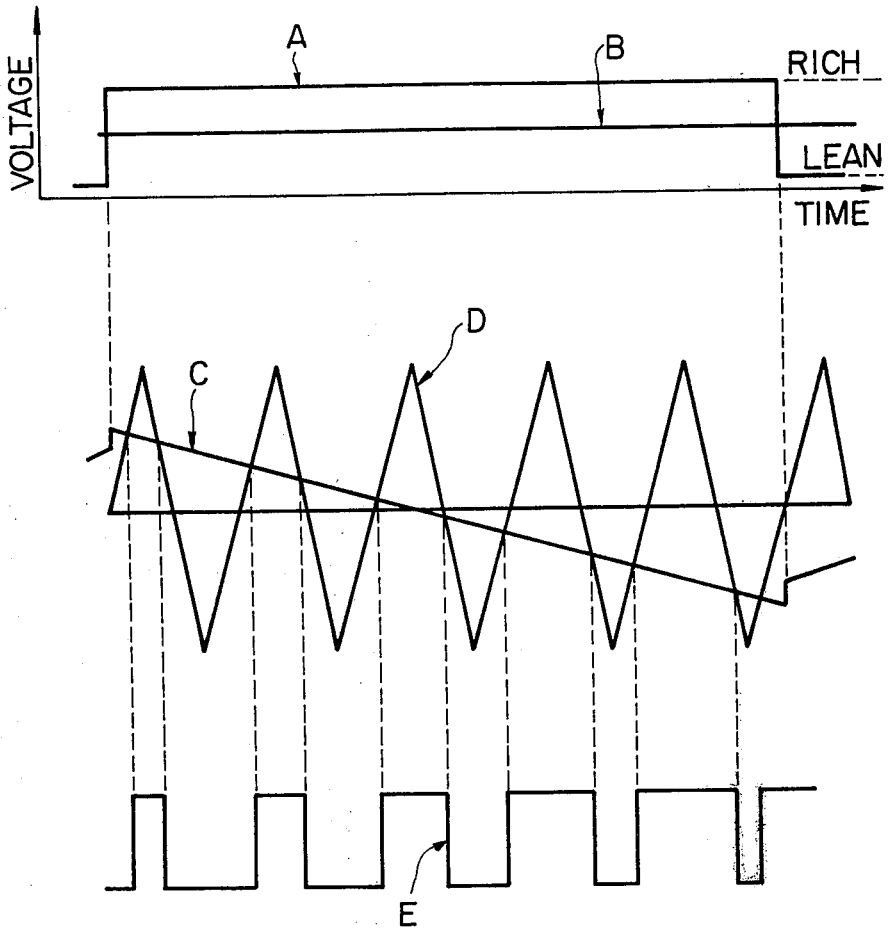
FIG. 3 shows various waveforms which demonstrate the basic control concept of the FIG. 2 system.

Reference is now made to FIGS. 2 and 3, wherein schematically illustrated are an example of a conventional electrical closed loop air-fuel control system for use with an internal combustion engine 100 having the carburetor shown in FIG. 1 and several waveforms developed at or derived from different elements of the FIG. 2 system (FIG. 3). The purpose of the system is to electrically control the air-fuel ratio of an air-fuel mixture supplied to the engine 100. A sensor 102, such as an oxygen analyzer, for sensing the concentration of oxygen in exhaust gases is disposed in an exhaust pipe 101 in such a manner as to be exposed to the exhaust gases. An electrical signal derived from the sensor 102 is fed to a differential signal generator 104 which generates an electrical signal representative of a difference value between the magnitudes of the signal from the sensor 102 and a reference signal. A portion of the waveform of the signal from the sensor 102 is depicted by reference character A in FIG. 3. The reference signal magnitude, which is illustrated by reference character B in FIG. 3, is previously determined in due consideration of optimum air-fuel ratio of the air-fuel mixture supplied to the engine 100 for maximizing the efficiency of the three-way catalytic converter (not shown) provided in the exhaust pipe 101 downstream of the sensor 102, etc. The signal representative of the difference value from the differential signal generator 104 is then fed to control means 106 which usually includes a conventional p-i (proportional-integral) controller. The provision of the p-i controller, as is well known in the art, is to improve the efficiency of the electronic closed loop control system, in other words, to facilitate a rapid transient response of the system. The output signal from the control means 106, which is depicted by reference character C in FIG. 3, is fed to the next stage, vi/., a pulse generator 108 which also receives a dither signal (D in FIG. 3) from a dither signal generator 110 to generate a signal E consisting of a train of pulses as shown in FIG. 3. Each pulse of the signal E has a width which corresponds to the duration when the signal D is larger than the signal C as schematically shown in FIG. 3. The train of pulses of the signal E is then fed to the electromagnetic valve 10 in order to regulate the air-fuel mixture ratio as described in connection with FIG. 1.

Figure 4:
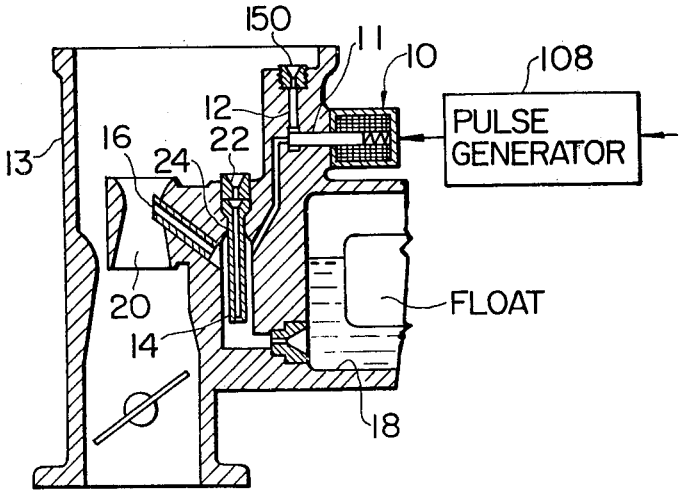
FIG. 4 shows a first preferred embodiment of the present invention.

Reference is now made to FIG. 4, which schematically illustrates a first embodiment of the present invention. The first embodiment is analogous to the conventional one as shown in FIG. 1 except that the former is equipped with a detachable member 150 with a suitable orifice (no numeral). The member 150 is snugly fitted in the upper portion of the air passage 12 by, for example, being screwed into a portion provided therein. Therefore, the fine adjustment of the air flow rate is readily carried out by replacing the member 150 by the other one with a more appropriate orifice.

Figure 5:
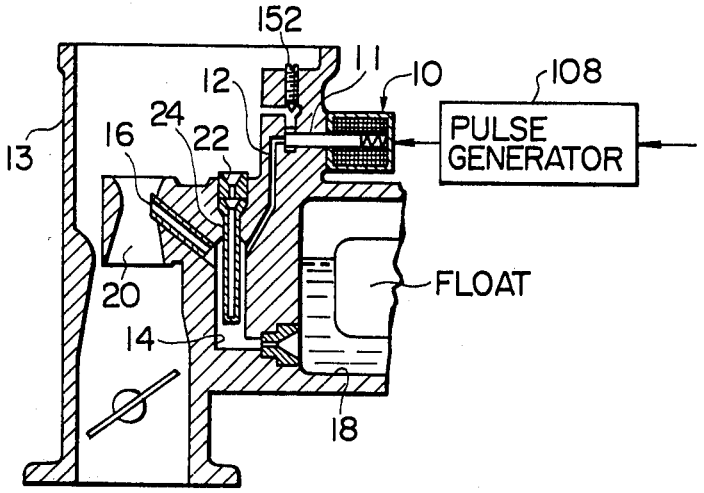
FIG. 5 shows a second preferred embodiment of the present invention.

In FIG. 5, there is illustrated a second preferred embodiment of the present invention wherein a member 152 is added to the conventional carburetor of FIG. 1. The member 152 is preferably an regulating screw which adjustably protrudes into the air passage 12 to continuously vary the cross-sectional area of part of the air passage 12 for changing the amount of air flowing therethrough, and thereby performing the fine adjustment of the air-fuel ratio. In FIG. 5, the member 152 is provided upstream of the plunger 11, but, alternatively, it can be arranged downstream thereof. Furthermore, the member 152 is not restricted to a needle type, but any other type may be available on condition that the above-described continuous change of the cross-sectional area can be obtained.

Finally, reference is now made to FIGS. 6*a* and 6*b*, wherein a third preferred embodiment of the present invention is schematically illustrated. The third embodiment is equipped with an additional member 154 as compared with the conventional carburetor of FIG. 1. The member 154 is a regulating screw which serves to change the stroke of the plunger 11 by means of a protruding member 156 as best seen in FIG. 6*b*, and thereby changing the opening at the open position of the plunger 11. Consequently, the provision of the element 154 makes possible the aforementioned fine adjustment of the air-fuel mixture ratio by changing the amount of the air flowing through the air passage 12.

In the last mentioned embodiment, another fine adjustment of the air-fuel mixture ratio can be achieved by replacing the spring 158 by the other one with a more appropriate spring constant so as to regulate the maximum stroke of the plunger 11, in the case of which the member 156 is omitted.

From the above, it is understood that, in accordance with the preferred embodiments of the present invention, the fine adjustment of the air-fuel mixture ratio of a carburetor, which is used with an electronic closed loop control system, can be readily performed in a simple manner, so that the above-described advantages are obtainable with ease.

What is claimed is:

1. An automotive engine carburetor for use with an electronic closed loop air-fuel ratio control system to supply adequate air-fuel mixture to an internal combustion engine for effectively reducing noxious components in exhaust gases from the engine by a three-way catalytic converter, comprising:

an intake passage provided with a venturi;

a float bowl for containing fuel therein;

a fuel passage extending between said venturi and said float bowl;

an air bleed passage connected to said fuel passage for delivering air thereto;

an auxiliary air passage connected to said fuel passage for delivering air thereto; and an electromagnetic valve assembly of on/off type serving as an actuator operatively connected to said air bleed passage for controlling the rate of air flow in response to an electrical pulsating signal applied thereto from said electronic closed loop air-fuel ratio control system to supply an adequate air-fuel mixture to said internal combustion engine, said valve assembly having a member movable reciprocally in response to said pulsating signal between a first position in which the amount of air passing through said air bleed passage is at a maximum and a second position in which said amount of air is at a minimum, and means for providing adjustment of the distance of the valve member between said first and second positions.

2. An automotive engine carburetor as claimed in claim 1, wherein said adjusting means comprises a regulating screw.

3. An automotive engine carburetor as claimed in claim 1, wherein said adjusting means comprises an adjustable spring.

4. An automotive engine carburetor for a closed loop mixture control system including means for generating a signal representative of the deviation of air-fuel ratio within an exhaust system of an internal combustion engine from a desire air-fuel ratio, means for converting the magnitude of the signal into a train of electrical pulses of which the pulse duration is dependent on the magnitude of said signal, and a three-way catalytic converter located in the exhaust system is substantially controlled at said desired air-fuel ratio, comprising:

an intake passage provided with a venturi;

a float bowl for containing fuel therein; a fuel passage extending between said venturi and said float bowl;

an air bleed passage connected to said fuel passage for delivering air thereto;

an auxiliary passage connected to said fuel passage for delivering air thereto; and an electromagnetic valve of on/off type operable to respond to said electrical pulses to permit passage of air through said air bleed passage in proportion to the pulse duration, said valve assembly having a valve member movable reciprocally in response to said pulse between a first position in which the amount of air passing through said air bleed passage is at a maximum and a second position in which said amount of air is at a minimum, and means for providing adjustment of the distance of the valve member between said first and second positions.

* * * * *